US007884697B2

(12) United States Patent
Wei et al.

(10) Patent No.: US 7,884,697 B2
(45) Date of Patent: Feb. 8, 2011

(54) TUNABLE EMBEDDED INDUCTOR DEVICES

(75) Inventors: Chang-Lin Wei, Hsinchu (TW); Cheng-Hua Tsai, Taipei (TW); Chin-Sun Shyu, Pingtung Hsien (TW); Kuo-Chiang Chin, Taipei (TW); Syun Yu, Chiayi (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/037,622

(22) Filed: Feb. 26, 2008

(65) Prior Publication Data

US 2008/0297298 A1 Dec. 4, 2008

(30) Foreign Application Priority Data

Jun. 1, 2007 (TW) ..... 96119711 A
Jan. 22, 2008 (TW) ..... 97102357 A

(51) Int. Cl.
*H01F 5/00* (2006.01)

(52) U.S. Cl. ..... 336/200; 336/223; 336/232

(58) Field of Classification Search ..... 336/200, 336/232, 223, 83
See application file for complete search history.

(56) References Cited

U.S. PATENT DOCUMENTS 4,942,373 A * 7/1990 Ozawa et al. ..... 333/161
6,005,467 A 12/1999 Abramov
6,556,416 B2 * 4/2003 Kunihiro ..... 361/277
6,727,571 B2 4/2004 Sugiyama et al.
6,931,712 B2 * 8/2005 Long et al. ..... 29/602.1
7,598,836 B2 * 10/2009 Lee ..... 336/147
7,656,264 B2 * 2/2010 Hsu et al. ..... 336/223
2006/0145805 A1 * 7/2006 Kim et al. ..... 336/200
2007/0090912 A1 * 4/2007 Lee ..... 336/200
2008/0094166 A1 * 4/2008 Hsu et al. ..... 336/223

FOREIGN PATENT DOCUMENTS

TW I264021 10/2006

* cited by examiner

*Primary Examiner*—Lincoln Donovan
*Assistant Examiner*—Joselito Baisa

(57) ABSTRACT

The invention provides tunable embedded high frequency inductor devices. The inductor device comprises a dielectric substrate. A first conductive line is disposed on a first surface of the dielectric substrate. A second conductive line is disposed on a second surface of the dielectric substrate. An interconnection is disposed perforating the dielectric substrate and connecting the first conductive line with the second conductive line. A coupling region is defined between the first and the second conductive lines. A conductive plug connecting the first conductive line and the second line is disposed in the coupling region. Alternatively, an opening is disposed in the first and second conductive lines to tune inductance of the inductor.

24 Claims, 14 Drawing Sheets

TUNABLE EMBEDDED INDUCTOR DEVICES

BACKGROUND OF THE INVENTION

1. Field of the Invention

The invention relates to tunable embedded inductor devices, and in particular to tunable embedded high frequency integrated inductor devices.

2. Description of the Related Art

Embedded inductor devices have been applied in various circuits including resonators, filters, and matching networks. Among applications of wireless communication, digital computer, portable electronics, and information household appliance, features with higher frequencies, broader bandwidths, and miniaturization have become main requirements of high-tech industries and commercial markets. During development and design of high frequency circuit modules, consideration must be given to inductor devices, as they are electrically coupled to other peripheral circuits or devices and may be vulnerably interfered with thereof. Additionally, the inductor devices can be affected by process and material variations such that characteristics of the inductor devices are not precise, resulting in detrimental performance of the entire circuitry. For example, when an inductor device is configured in an oscillator, oscillation frequency of the oscillator can be shifted due to inductance deviation of the inductor device. Therefore, a tunable embedded inductor device is needed to meet specifications of oscillators.

When conventional embedded inductor devices, such as spiral inductors or solenoid inductors are applied in a circuit module, inductance of the embedded inductor devices is regulated by changing circuit layout design. Each time the circuit layout design is changed, the high frequency circuit module testing boards are also remade, thereby increasing processing period and fabrication costs.

U.S. Pat. No. 6,005,467, the entirety of which is hereby incorporated by reference, discloses a three dimensional wound inductor device. An additional electric conductive shorting member extending and electrically connected between windings is introduced during the inductor winding process to adjust inductance of the entire circuit.

FIG. 1 is a stereographic view of a conventional three dimensional wound inductor device. Referring to FIG. 1, a three dimensional (3D) wound inductor device 1 includes a substrate 20 and two lateral planes 10 and 12. Three turns of windings 22, 24, and 26 surround the substrate 20 configured as a solenoid coil. An electric conductive shorting member 28 is disposed on one of the lateral planes connecting each turns of windings 22, 24, and 26 at wielding spots 32, 34 and 36. By cutting the electric conductive shorting member 28 at cutting site C, inductance of the 3D wound inductor device 1 is adjusted as winding turns of the solenoid coil change. However, formation of the electric conductive shorting member is not suitable for regulating high frequency inductor device embedded in functional substrates.

Furthermore, U.S. Pat. No. 6,727,571, the entirety of which is hereby incorporated by reference discloses a tunable embedded inductor device. Inductance of the inductor device can be adjusted by trimming width of the conductive windings. FIG. 2 is a schematic view of a conventional planar wound inductor device. Referring to FIG. 2, a planar wound inductor device includes a planar spiral coil 52 disposed on a substrate 51. The planar spiral coil 52 is composed of segments 52*a*, 52*b*, 52*c*, and 52*d* arranged as a loop. By trimming the width of the segments 52*a*, 52*b*, 52*c*, and 52*d* and by changing interval therebetween, inductance of the planar wound inductor device can be regulated. Conventional planar wound inductor devices can not be integrated into multi-layered inductor structures. More specifically, when a passivation layer or an outer substrate is formed on the planar wound inductor device, it is difficult to precisely trim segments of the planar spiral coil.

BRIEF SUMMARY OF THE INVENTION

A detailed description is given in the following embodiments with reference to the accompanying drawings.

The invention relates to layouts of a tunable embedded single-layered and/or multi-layered inductor devices. Openings in the conductive lines of the inductor device are formed by drilling the substrate, or additional conductive contacts are formed between conductive lines on different layers, thereby regulating inductance of the embedded single-layered and/or multi-layered inductor devices. Note that inductance of the embedded inductor devices can either increase or decrease to precisely fulfill specifications of circuit modules.

Embodiments of the invention provide a tunable embedded inductor device, comprising: a dielectric substrate; a first conductive line disposed on a first surface of the dielectric substrate; a second conductive line disposed on a second surface of the dielectric substrate; and an interconnection perforating the dielectric substrate and connecting the first conductive line with the second conductive line; wherein a coupling region is defined between the first and the second conductive lines and wherein the coupling region comprises a conductive plug connecting the first conductive line and the second line, or an opening disposed in the first conductive line or the second conductive line to tune inductance of the inductor device.

Embodiments of the invention further provide a tunable embedded inductor device, comprising: a multi-layered substrate; a first conductive line disposed on a first surface of the multi-layered substrate; a second conductive line disposed on a second surface of the multi-layered substrate; a third conductive line disposed on an inner layer's surface of the multi-layered substrate; a first interconnection connecting the first conductive line and the third conductive line; a second interconnection connecting the second conductive line and the third conductive line; wherein a coupling region is defined between the first and the second conductive lines and wherein the coupling region comprises a conductive plug connecting the first conductive line and the second line to tune inductance of the inductor device.

BRIEF DESCRIPTION OF THE DRAWINGS

The invention can be more fully understood by reading the subsequent detailed description and examples with references made to the accompanying drawings, wherein:

FIG. 3A is a cross section of a local enlargement of an embodiment of an embedded inductor device of the invention, while

FIG. 4A is a schematic view of another embodiment of an embedded inductor devices, while

FIG. 5A is a schematic view of an embodiment of the invention reducing inductance of the embedded inductance device, while

FIG. 6A is a schematic view of an embodiment of the invention increasing inductance of the embedded inductance device, while

FIGS. 7A and 7B are simulation models using high frequency electromagnetic simulation software with high frequency scattering parameters, wherein FIG. 7A is an original model of an embedded inductor device, and wherein FIG. 7B is a model of a tunable embedded inductor device with three conductive plugs;

FIGS. 9A and 9B are simulation models using high frequency electromagnetic simulation software with high frequency scattering parameters, wherein FIG. 9A is a model of a tunable embedded inductor device with openings in either the first conductive line or the second conductive line, and wherein FIG. 9B is a model of a tunable embedded inductor device with openings in both the first and second conductive lines;

DETAILED DESCRIPTION OF THE INVENTION

Figure 1:
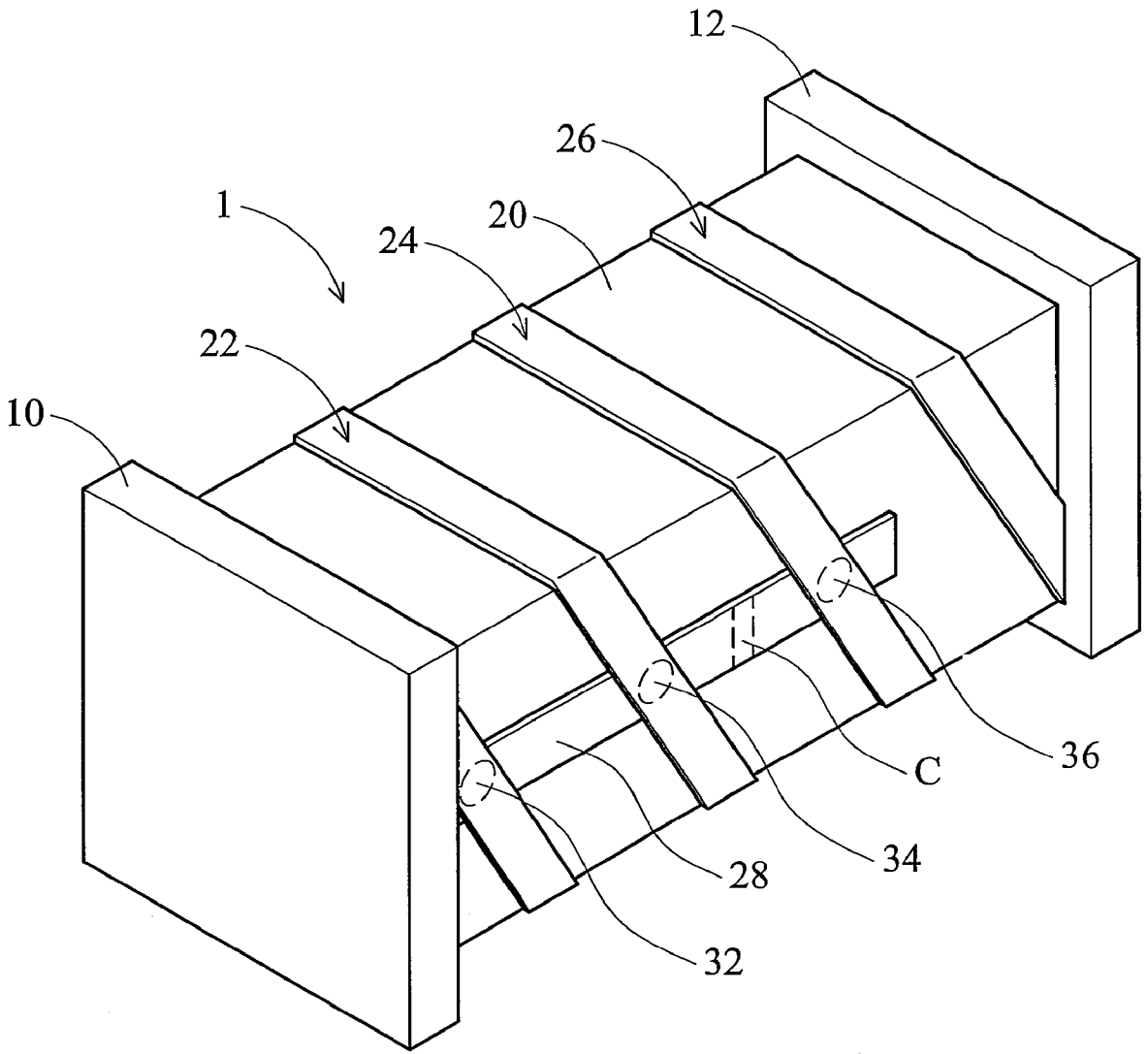
FIG. 1 (PRIOR ART)
FIG. 1 is a stereographic view of a conventional three dimensional wound inductor device.
Figure 2A:
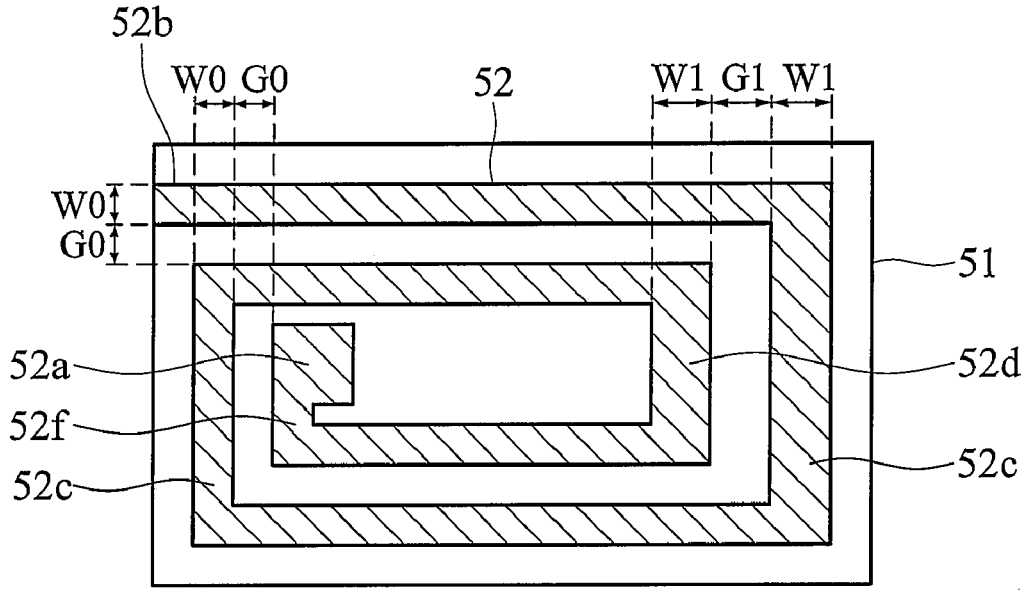
FIG. 2A (PRIOR ART)
FIGS. 2A and 2B are schematic views of conventional planar wound inductor devices.
Figure 2B:
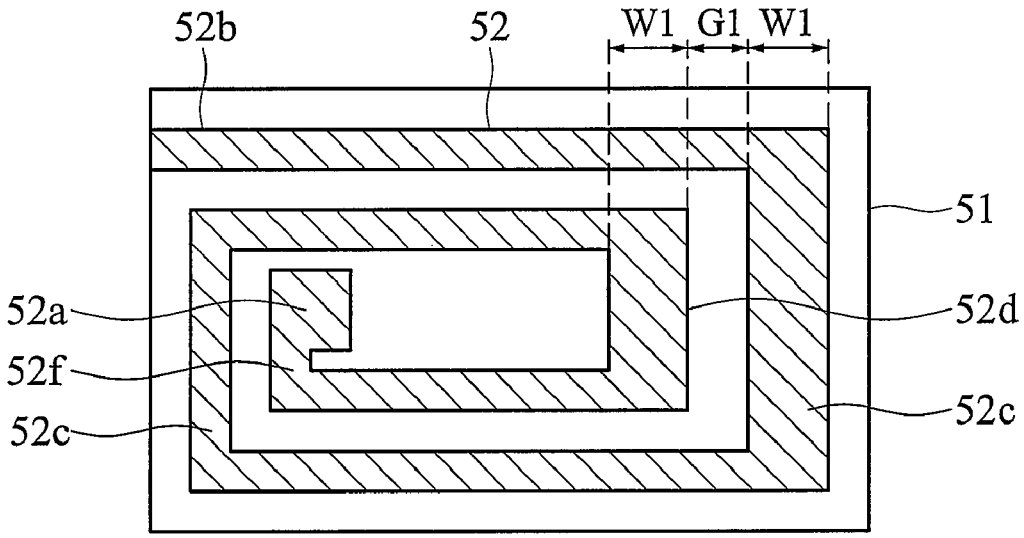
FIG. 2B (PRIOR ART)

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself indicate a relationship between the various embodiments and/or configurations discussed. Moreover, the formation of a first feature over or on a second feature in the description that follows may include embodiments in which the first and second features are formed in direct contact or not in direct contact.

As mentioned previously, during development and design of high frequency circuit modules, consideration must be given to inductor devices, as they are electrically coupled to other peripheral circuits or devices and may be vulnerably interfered with thereof. Additionally, the inductor devices can be affected by process and material variations such that characteristics of the inductor devices are not precise, resulting in detrimental performance of the entire circuitry. Embodiments of the invention provide formation of openings to increase inductance of the embedded inductor device and formation of additional conductive plugs (connections) to decrease inductance of the embedded inductor device.

Figure 3A:
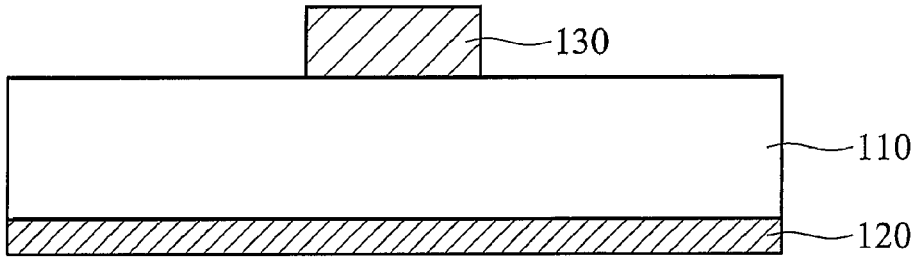
Figure 3B:
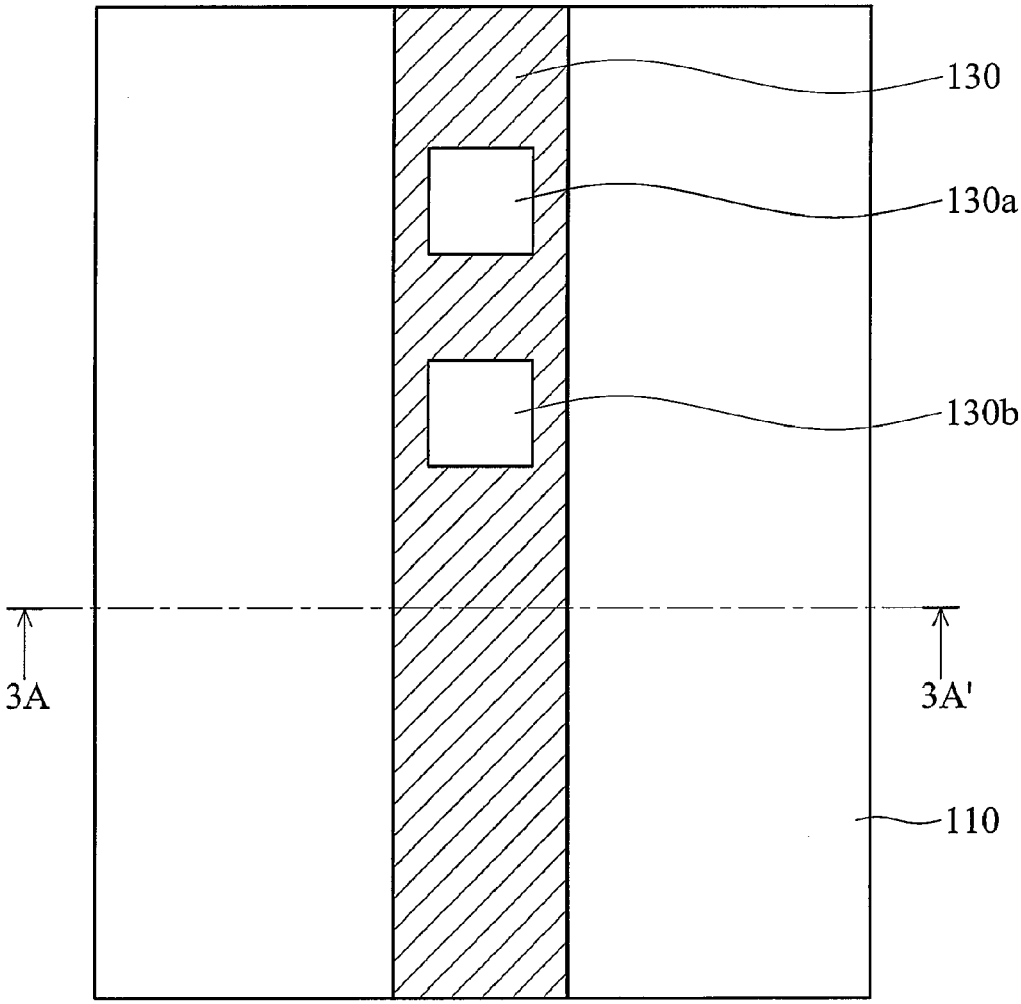
FIG. 3B is a plan view of the exemplary embedded inductor device of FIG. 3A.

FIG. 3A is a cross section of a local enlargement of an embodiment of an embedded inductor device of the invention, while FIG. 3B is a plan view of the exemplary embedded inductor device of FIG. 3A. Referring to FIG. 3A, a conductive coil 130 of the embedded inductor device is disposed on a dielectric substrate 110. A ground plane 120 is formed on the back of the dielectric substrate 110. According to embodiments of the invention, openings 130*a* and 130*b* are formed in the conductive coil 130 by etching, non-electroplating drilling or mechanical sculpting to increase inductance of the embedded inductor device, as shown in FIG. 3B.

Figure 4A:
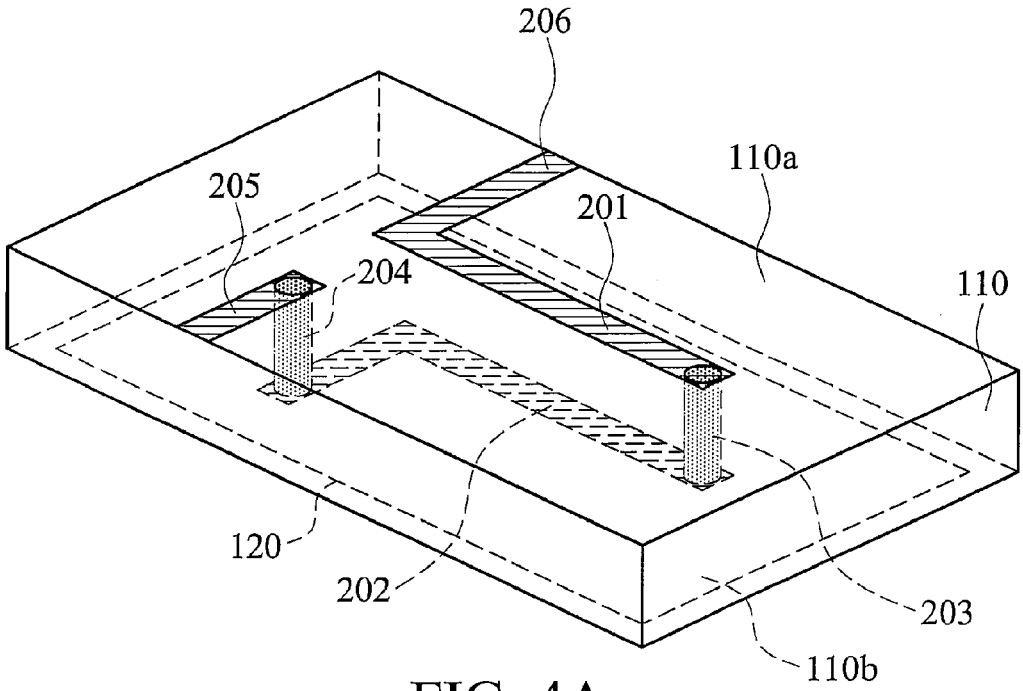
Figure 4B:
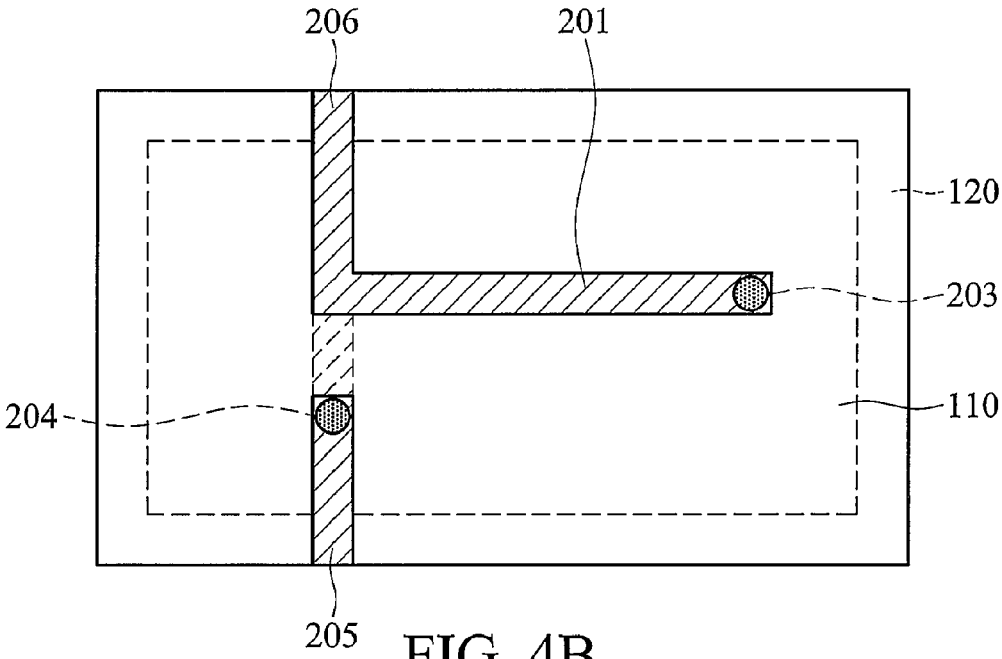
FIG. 4B is a plan view of the embedded inductor device of FIG. 4A.

FIG. 4A is a schematic view of another embodiment of an embedded inductor devices, while FIG. 4B is a plan view of the embedded inductor device of FIG. 4A. Referring to FIG. 4A, an embedded inductor device can be formed on any area of a circuit board. The embedded inductor device includes a dielectric substrate 110 with a first surface 110*a* and a second surface 110*b*. Within the dielectric substrate 110, there are no other metals except the embedded inductive winding, thereby reducing parasitic capacitance effect. The embedded inductive winding comprises a first conductive line 201 disposed on the first surface 110*a* of the dielectric substrate 110 and a second conductive line 202 disposed on the second surface 110*b* of the dielectric substrate 110. An interconnection 203 such as a conductive plug or a via hole perforates the dielectric substrate 110 and connects between the first conductive line 201 and the second conductive line 202, thus configured as a two-port inductor. The embedded inductor device further includes an input end connecting another interconnection 204, the second conductive line 202, the first conductive line 201, and an output end 206, thereby creating a 3D embedded inductor loop.

Note that the dielectric substrate 110 comprises a polymer substrate, a ceramic substrate, or a semiconductor substrate, and the dielectric substrate 110 can be a single-layered substrate composed of single material, or a multi-layered substrate composed of different materials. Alternatively or optionally, the dielectric substrate 110 can further comprise a circuit composed of at least one active device or passive device.

Referring to FIG. 4B, a ground plane 120, isolated from other devices of the circuit module, can be additionally formed on the second surface of the dielectric substrate to prevent parasitic effect therefrom. Since addition of the ground plane is substantially independent from regulating inductance of the embedded inductor device, in some embodiments of the invention the ground plane can be omitted.

Figure 5A:
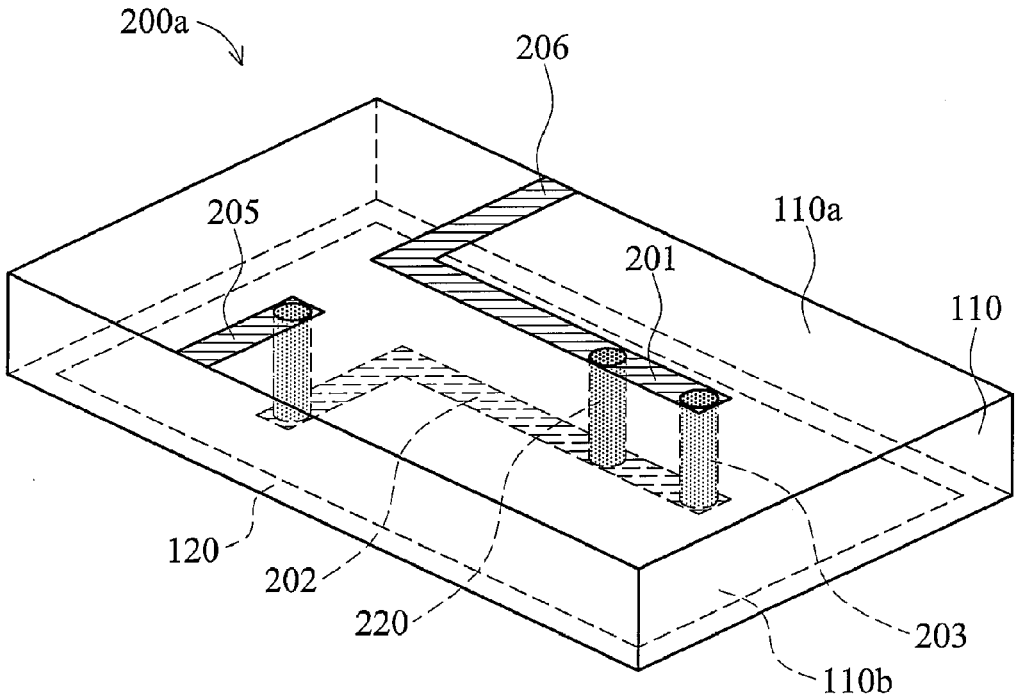
Figure 5B:
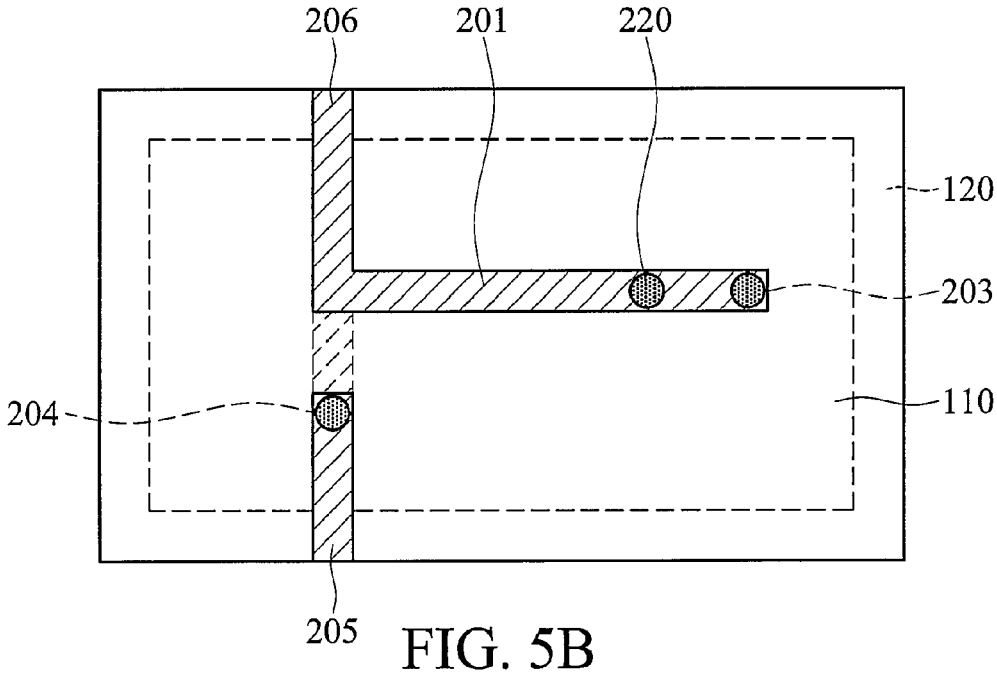
FIG. 5B is a plan view of the embedded inductance device of FIG. 5A.

FIG. 5A is a schematic view of an embodiment of the invention reducing inductance of the embedded inductance device, while FIG. 5B is a plan view of the embedded inductance device of FIG. 5A. Referring to FIG. 5A, an embedded inductance device 200*a* includes a first conductive line 201 and a second conductive line 202 with a coupling region therebetween. The coupling region comprises an additional conductive plug 220 connecting the first conductive line 201 and the second line 202, thereby reducing the circuit route of the embedded inductor device and reducing inductance thereof. By adjusting the position of the additional conductive plug 220, inductance of the embedded inductor device in the entire circuit module can be therefore fine tuned. It is conceivable that impedance mismatches with the network can thus be prevented and optimization of the entire circuit module can thus be reached.

Referring to FIG. 5B, according to an embodiment of the invention, a ground plane 120, isolated from other devices of the circuit module, can be additionally formed on the second surface of the dielectric substrate to prevent parasitic effect therefrom. Since addition of the ground plane is substantially independent from regulating inductance of the embedded inductor device, in some embodiments of the invention the ground plane can be omitted.

Figure 6A:
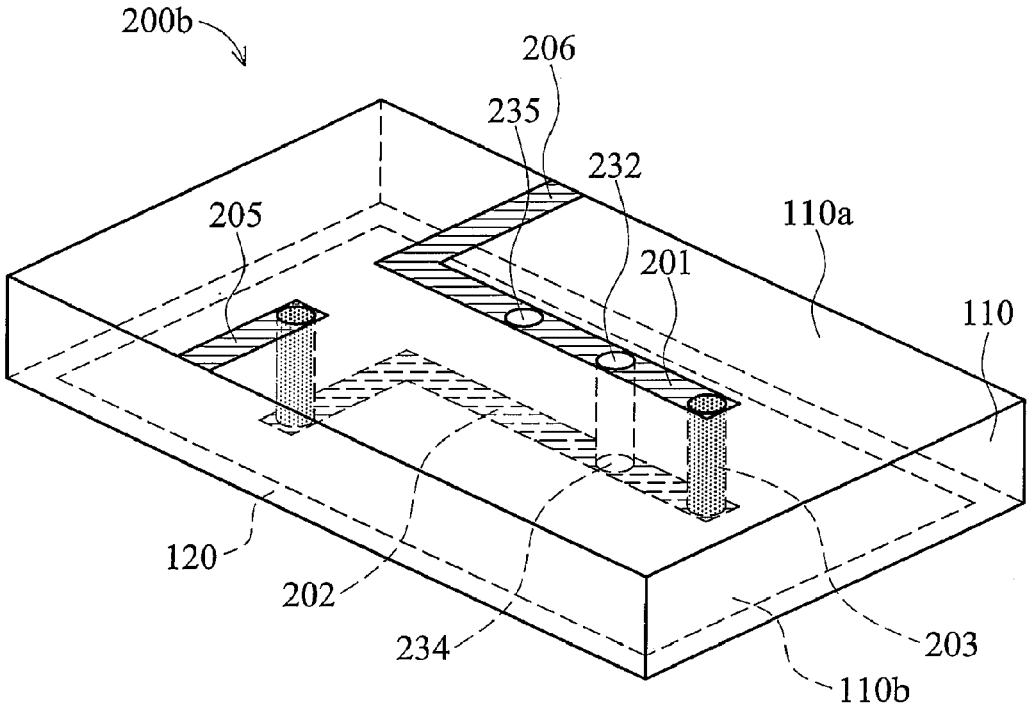
Figure 6B:
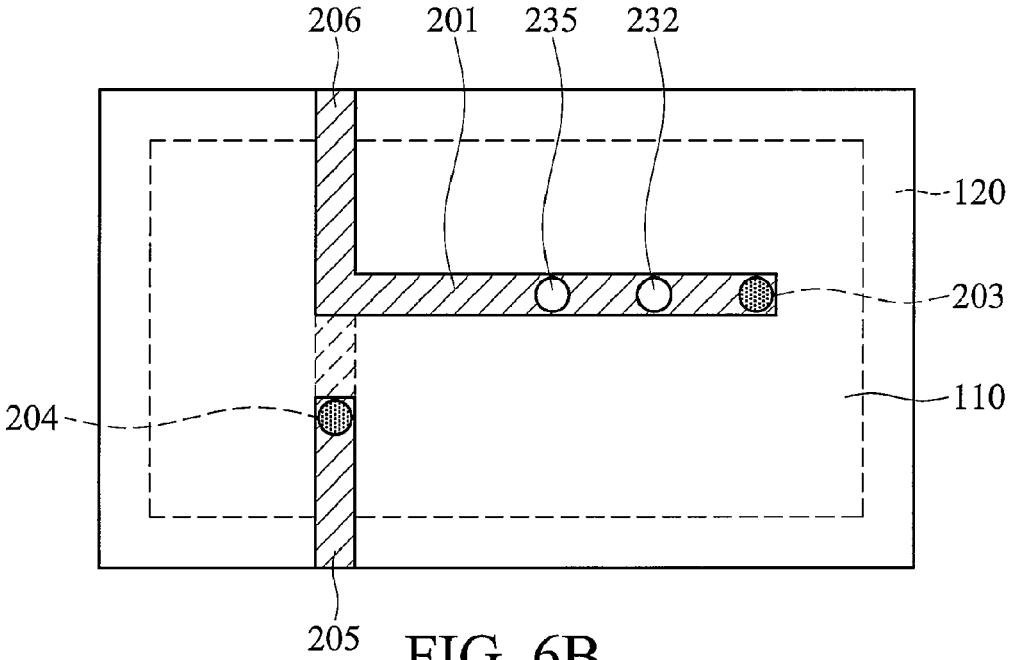
FIG. 6B is a plan view of the embedded inductance device of FIG. 6A.

FIG. 6A is a schematic view of an embodiment of the invention increasing inductance of the embedded inductance device, while FIG. 6B is a plan view of the embedded inductance device of FIG. 6A. Referring to FIG. 6A, an embedded inductance device 200*b* includes a first conductive line 201 and a second conductive line 202 with a coupling region therebetween. The coupling region comprises an opening 232 disposed in the first conductive line 201, thereby increasing inductance of the embedded inductor device. The opening 232 can be a non-electroplating perforation through the dielectric substrate. The other end of the opening 232 can be disposed in the second conductive line 202 to increase inductance of the two-port inductor device. Note that the disposition of the single opening 235 is not limited to the coupling region of the first conductive line 201 and the second conductive line 202. More specifically, single sided opening 235 can be located within any position of the first conductive line 201 (i.e., unnecessary located within the coupling region of the first conductive line 201 and the second conductive line 202).

Referring to FIG. 6B, according to an embodiment of the invention, a ground plane 120, isolated from other devices of the circuit module, can be additionally formed on the second surface of the dielectric substrate to prevent parasitic effect therefrom. Since addition of the ground plane is substantially independent from regulating inductance of the embedded inductor device, in some embodiments of the invention the ground plane can be omitted.

Figure 7A:
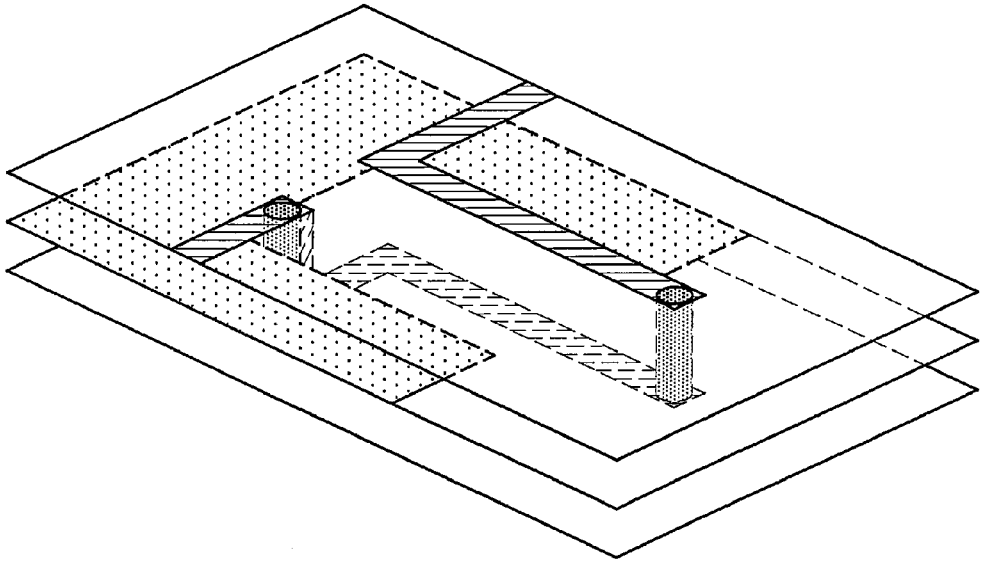
Figure 7B:
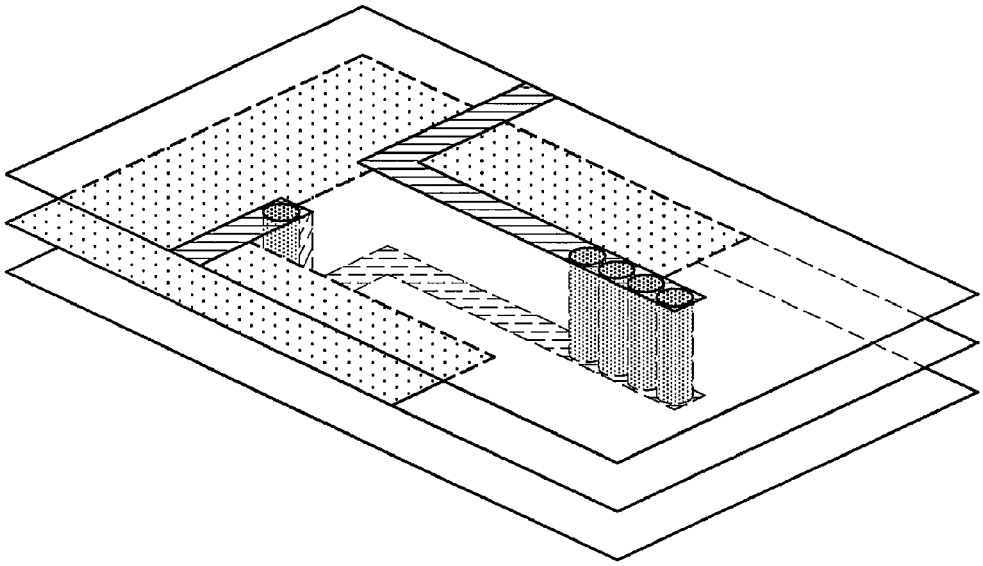
Figure 8:
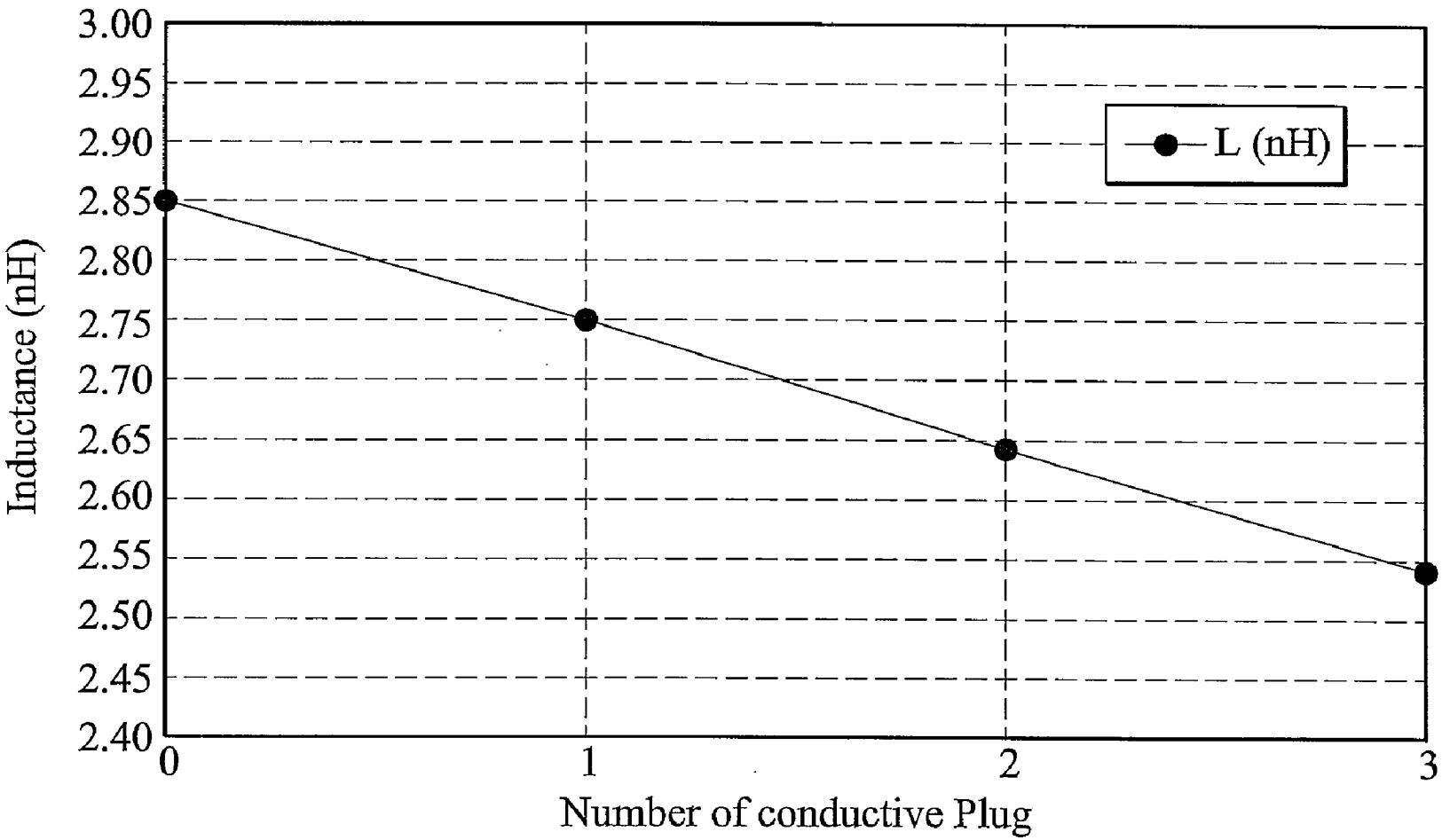
FIG. 8 shows simulated relationships between inductance of the embedded inductor device and numbers of conductive plugs.

FIGS. 7A and 7B are simulation models using high frequency electromagnetic simulation software with high frequency scattering parameters, wherein FIG. 7A is an original model of an embedded inductor device, and FIG. 7B is a model of a tunable embedded inductor device with three conductive plugs. The simulated relationships between inductance of the embedded inductor device and numbers of conductive plugs are shown in FIG. 8. The inductance of the two-port embedded inductor device without additional conductive plug is about 2.85 nH. On the other hand, inductance of the two-port embedded inductor device with three conductive plugs is about 2.54 nH. Inductance of the two-port embedded inductor device is reduced about 11% by the addition of three conductive plugs. Moreover, it is conceivable that inductance of the two-port embedded inductor device decreases as the number of the conductive plugs increases, thus suitable for precisely fine-tuning the two-port embedded inductor device.

Figure 9A:
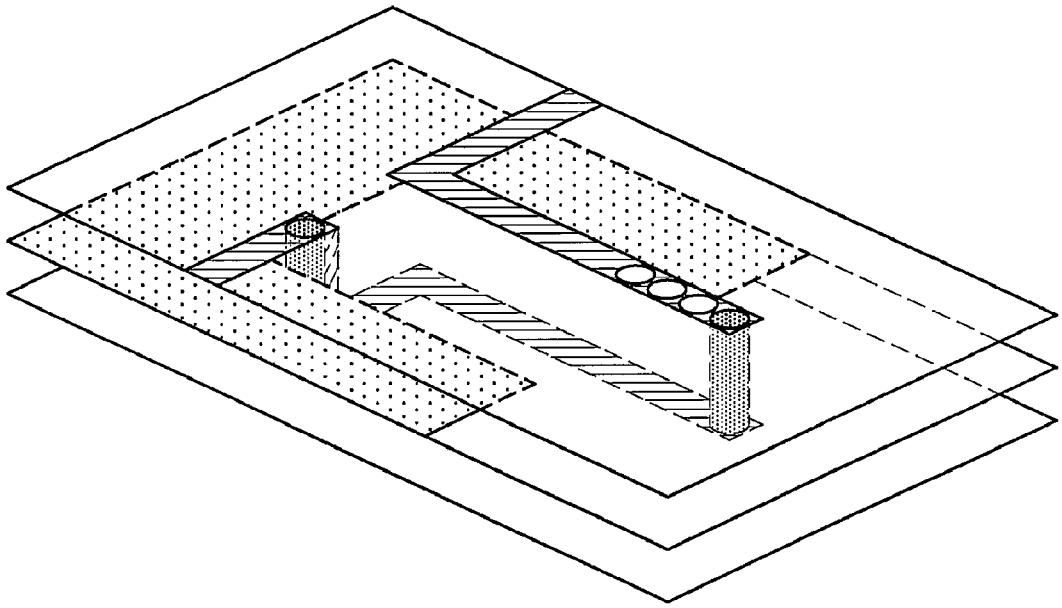
Figure 9B:
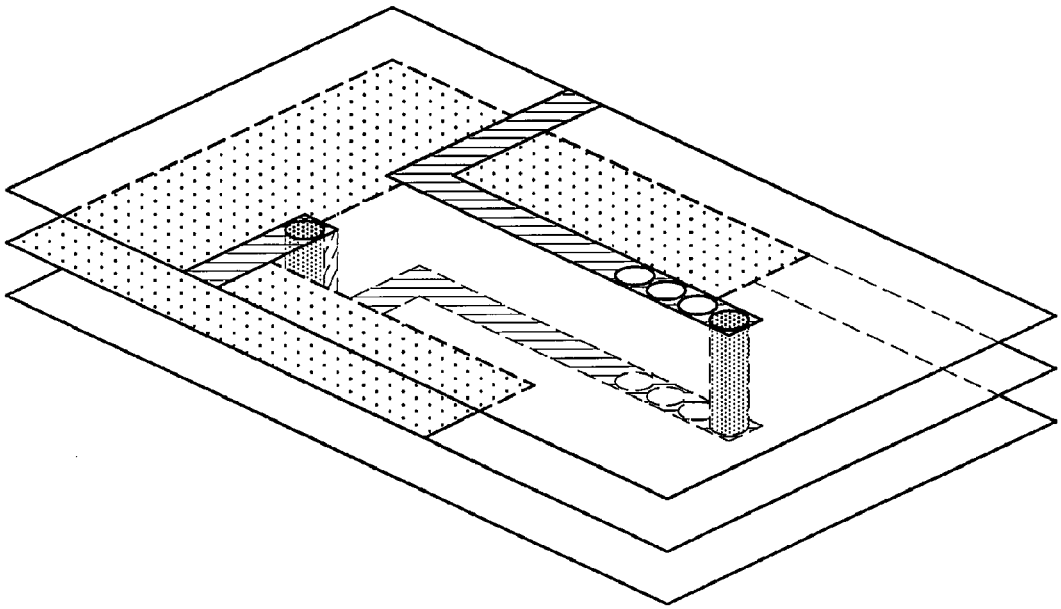
Figure 10:
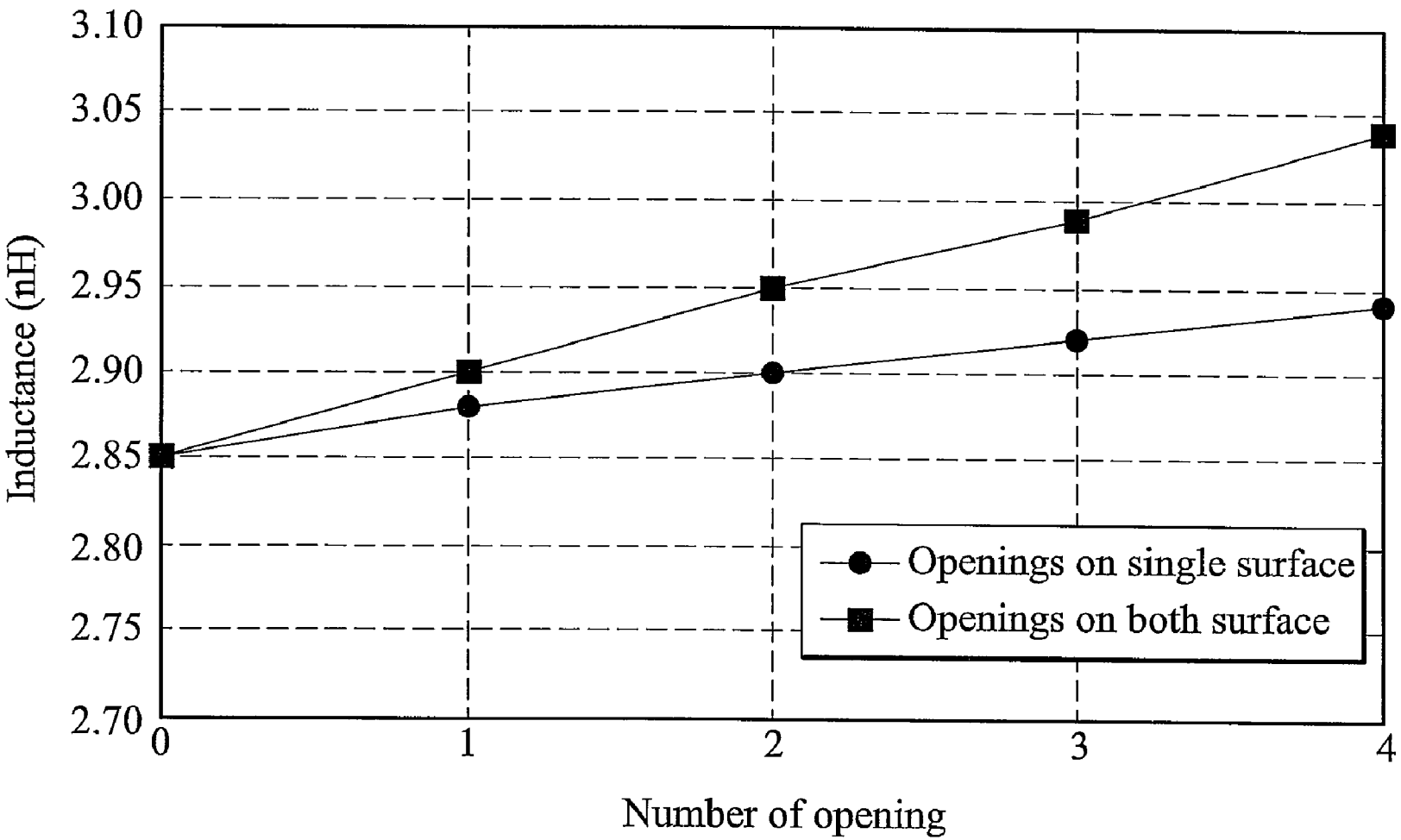
FIG. 10 shows simulated relationships between inductance of the embedded inductor device and numbers of openings.

FIGS. 9A and 9B are simulation models using high frequency electromagnetic simulation software with high frequency scattering parameters, wherein FIG. 9A is a model of a tunable embedded inductor device with openings in either the first conductive line or the second conductive line, and wherein FIG. 9B is a model of a tunable embedded inductor device with openings in both the first and second conductive lines. The simulated relationships between inductance of the embedded inductor device and numbers of openings are shown in FIG. 10. The inductance of the two-port embedded inductor device without additional non-electroplating perforation or opening is about 2.85 nH. On the other hand, inductance of the two-port embedded inductor device with four non-electroplating perforations or openings in both the first and second conductive lines is about 3.04 nH. Inductance of the two-port embedded inductor device increased about 7% with the addition of four non-electroplating perforations or openings. The two-port embedded inductor device with openings in both the first and second conductive lines has a greater increase in inductance than that with openings in the first conductive line. Moreover, it is conceivable that inductance of the two-port embedded inductor device increases as the number of the non-electroplating perforations or openings increases, thus suitable for precisely fine-tuning the two-port embedded inductor device.

Figure 11A:
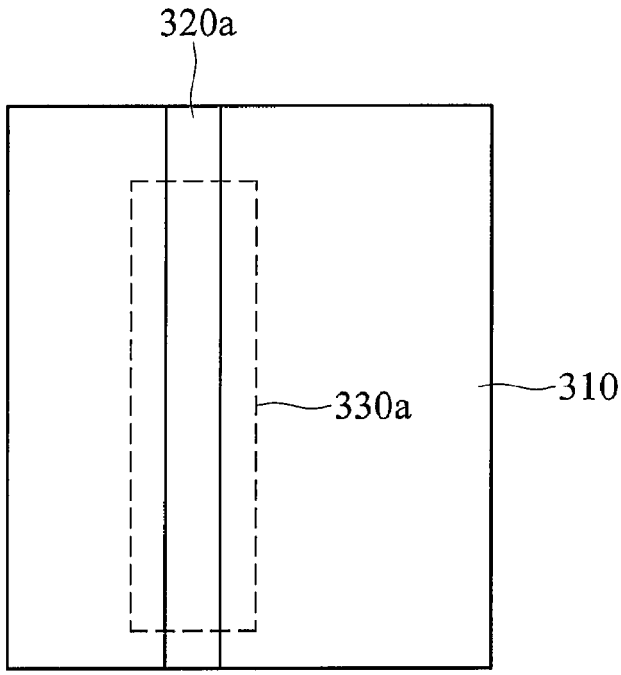
FIGS. 11A-11F are schematic views showing relative geographic relationships between the first conductive line and the second conductive line.
Figure 11B:
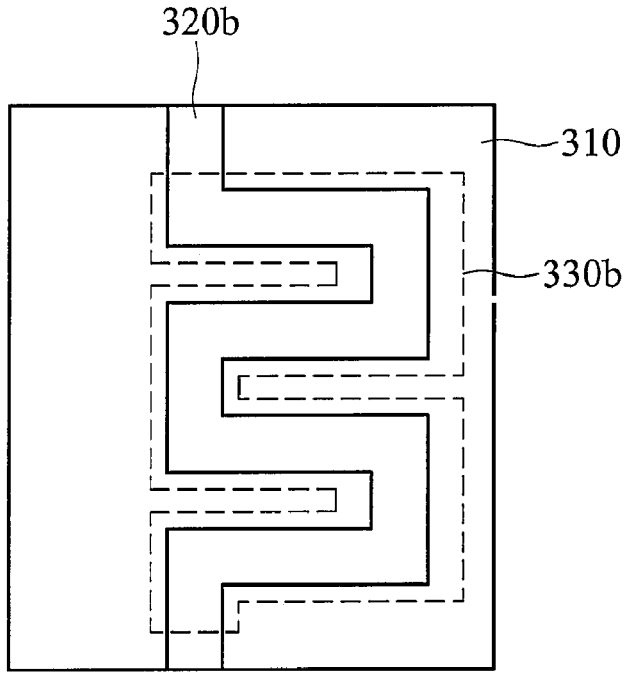
Figure 11C:
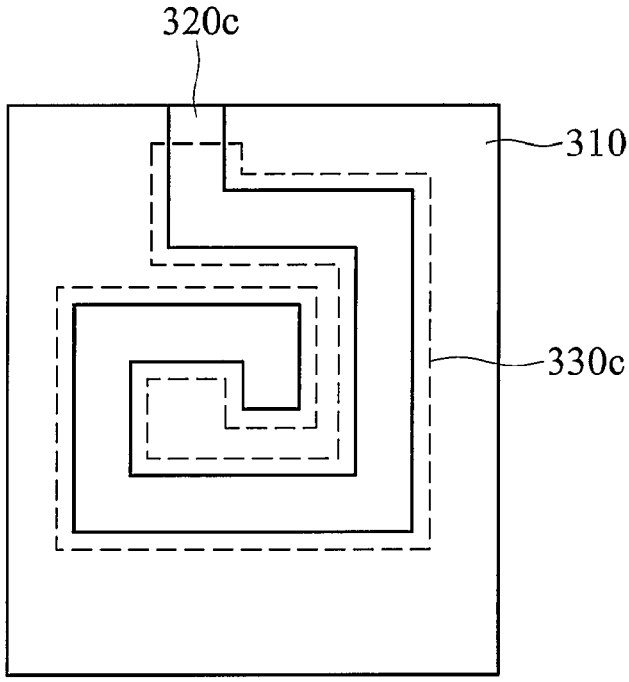

FIGS. 11A-11F are schematic views showing relative geographic relationships between the first conductive line and the second conductive line. Referring to FIGS. 11A-11C, the first conductive line and the second conductive line have the same shape or are conformal at the coupling region. For example, the first conductive line 320*a* on the first surface of the dielectric substrate 310 and the second conductive line 330*a* on the second surface are superimposed straight lines, as shown in FIG. 11A. Alternatively, the first conductive line 320*b* on the first surface of the dielectric substrate 310 and the second conductive line 330*b* on the second surface are superimposed serpentine lines, as shown in FIG. 11B. Moreover, the first conductive line 320*c* on the first surface of the dielectric substrate 310 and the second conductive line 330*c* on the second surface can also be superimposed spiral lines such as rectangular spiral lines, circular spiral lines, and polygonal spiral lines, as shown in FIG. 11C.

Figure 11D:
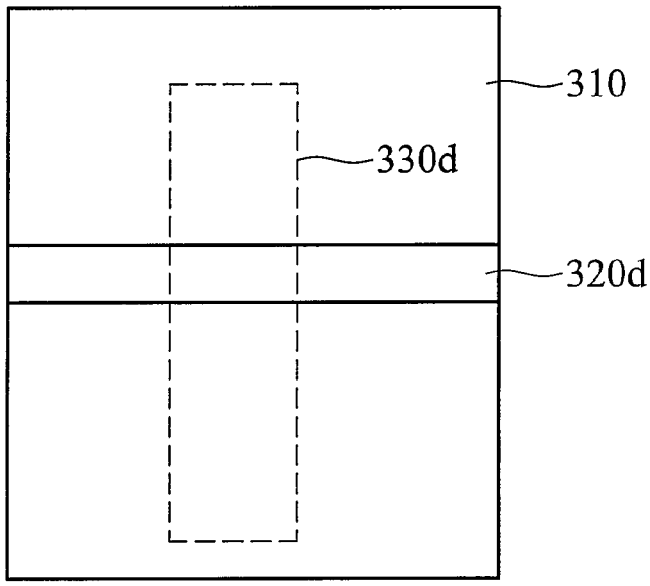
Figure 11E:
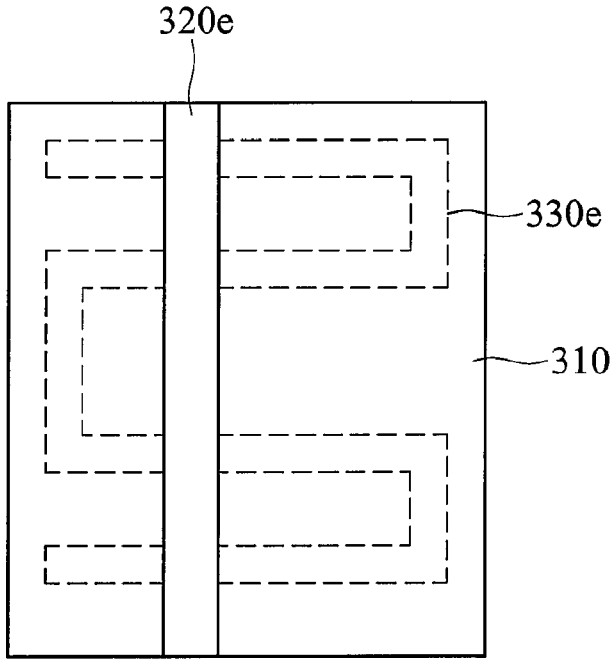
Figure 11F:
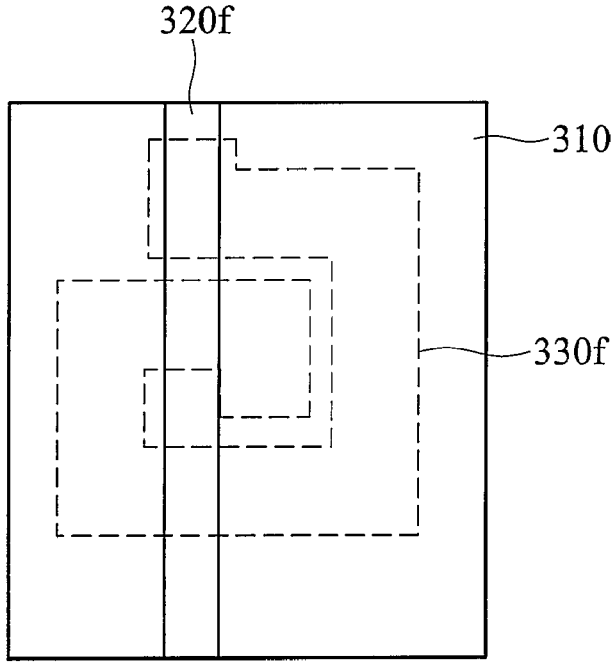

Referring to FIGS. 11D-11F, the first conductive line and the second conductive line are different in shape and have at least one overlapped point therebetween. For example, the first conductive line 320*d* on the first surface of the dielectric substrate 310 and the second conductive line 330*d* on the second surface are intercrossed straight lines, as shown in FIG. 11D. Alternatively, the first conductive line 320*e* on the first surface of the dielectric substrate 310 is a straight line, and the second conductive line 330*e* on the second surface is a serpentine line, as shown in FIG. 11E. Moreover, the first conductive line 320*f* on the first surface of the dielectric substrate 310 can be a straight line, and the second conductive line 330*f* on the second surface can be a spiral line such as a rectangular spiral line, a circular spiral line, and a polygonal spiral line, as shown in FIG. 11F.

Note that according to some embodiments of the invention, the shape of the conductive plugs or openings comprise a circle, a rectangle, a triangle or a polygon. The conductive plugs are composed of conductive materials or magnetic materials.

Figure 12:
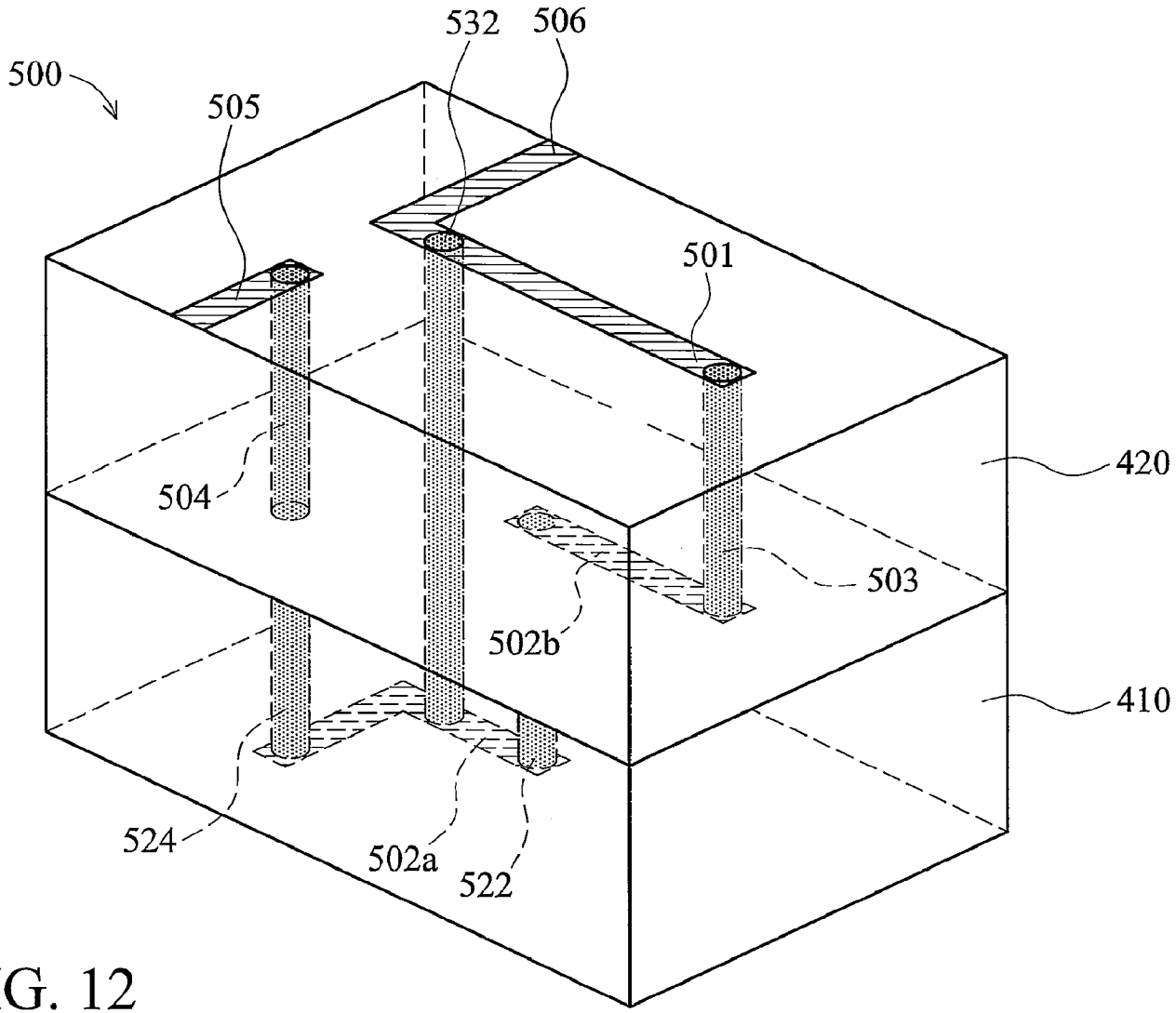
FIG. 12 is a schematic view of an embodiment of a 3D embedded inductor device wound in a multi-layered composite substrate.

The dielectric substrate of the embedded inductor device is not limited to a single-layered substrate, as a multi-layered composite substrate is also applicable thereto. FIG. 12 is a schematic view of an embodiment of a 3D embedded inductor device wound in a multi-layered composite substrate. Referring to FIG. 12, a 3D embedded inductor device 500 includes multi-layered laminated substrates 410 and 420. A first conductive line 501 is disposed on the first surface of the multi-layered laminated substrates. A second conductive line 502*a* is disposed on the second surface of the multi-layered laminated substrates. A third conductive line 502*b* is disposed on an inner layer's surface of the multi-layered laminated substrates. A first interconnection 503 connecting the first conductive line 501 and the third conductive line 502*b*. A second interconnection 522 connecting the second conductive line 502*a* and the third conductive line 502*b*. The 3D embedded inductor device 500 further includes an input end 505 and an output end 506 respectively connecting the first conductive line and the second conductive line, wherein a coupling region is defined between the first and the second conductive lines. The coupling region comprises a conductive plug 532 connecting the first conductive line 501 and the second line 502*a* to tune inductance of the inductor device.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A tunable embedded inductor device, comprising:

a primary coil comprising:

a dielectric substrate;

a first conductive line disposed on a first surface of the dielectric substrate;

a second conductive line disposed on a second surface of the dielectric substrate, wherein the first and second conductive lines are overlapped in a coupling region; and an interconnection perforating the dielectric substrate and connecting end sites of both the first conductive line and the second conductive line; and at least one conductive plug for tuning inductance independent from the primary coil and interpolated at a non-end site of the first and second conductive lines of the primary coil, wherein the least one conductive plug is within the coupling region and arranged to decrease inductance of the embedded inductor device.

2. The tunable embedded inductor device as claimed in claim 1, wherein the first conductive line and the second conductive line are conformal.

3. The tunable embedded inductor device as claimed in claim 2, wherein the first conductive line and the second conductive line are superimposed straight lines, superimposed serpentine lines, or superimposed spiral lines.

4. The tunable embedded inductor device as claimed in claim 3, wherein the superimposed spiral lines comprise rectangular spiral lines, circular spiral lines, and polygonal spiral lines.

5. The tunable embedded inductor device as claimed in claim 1, wherein the first conductive line and the second conductive line are different in shape and have at least one overlapped point therebetween.

6. The tunable embedded inductor device as claimed in claim 1, wherein the first conductive line and the second conductive line are intercrossed straight lines.

7. The tunable embedded inductor device as claimed in claim 6, wherein the first line is a straight line, and the second line is a serpentine line.

8. The tunable embedded inductor device as claimed in claim 6, wherein the first line is a straight line, and the second line is a spiral line.

9. The tunable embedded inductor device as claimed in claim 8, wherein the spiral line comprises a rectangular spiral line, a circular spiral line, and a polygonal spiral line.

10. The tunable embedded inductor device as claimed in claim 1, wherein the dielectric substrate comprises a polymer substrate, a ceramic substrate, or a semiconductor substrate, and wherein the dielectric substrate is a single-layered substrate composed of single material, or a multi-layered substrate composed of different materials.

11. The tunable embedded inductor device as claimed in claim 1, wherein the dielectric substrate comprises a circuit composed of at least one active device or passive device.

12. The tunable embedded inductor device as claimed in claim 1, wherein the shape of the least one conductive plug comprises a circle, a rectangle, a triangle or a polygon.

13. The tunable embedded inductor device as claimed in claim 1, wherein the least one conductive plug is composed of conductive materials or magnetic materials.

14. The tunable embedded inductor device as claimed in claim 1, wherein the primary coil is a multi-layered coil and the dielectric substrate is a multi-layered substrate, and the tunable embedded inductor device further comprises a third conductive line disposed on an inner layer's surface of the multi-layered substrate, wherein the interconnection comprises a first interconnection connecting end sites of both the first conductive line and the third conductive line; and a second interconnection connecting end sites of both the second conductive line and the third conductive line.

15. A tunable embedded inductor device, comprising:

a primary coil comprising:

a dielectric substrate;

a first conductive line disposed on a first surface of the dielectric substrate;

a second conductive line disposed on a second surface of the dielectric substrate, wherein the first and second conductive lines are overlapped in a coupling region; and an interconnection perforating the dielectric substrate and connecting end sites of both the first conductive line and the second conductive line, wherein the first conductive line, the second conductive line and the interconnection constitute a circuit of the primary coil; and at least one opening for tuning inductance independent from the primary coil and interpolated at a non-end site of the first and second conductive lines of the primary coil, wherein the least one opening is within the coupling region and arranged to affect inductance of the embedded inductor device.

16. The tunable embedded inductor device as claimed in claim 15, wherein the first conductive line and the second conductive line are conformal.

17. The tunable embedded inductor device as claimed in claim 16, wherein the first conductive line and the second conductive line are superimposed straight lines, superimposed serpentine lines, or superimposed spiral lines.

18. The tunable embedded inductor device as claimed in claim 15, wherein the first conductive line and the second conductive line are different in shape and have at least one overlapped point therebetween.

19. The tunable embedded inductor device as claimed in claim 18, wherein the first conductive line and the second conductive line are intercrossed straight lines.

20. The tunable embedded inductor device as claimed in claim 18, wherein the first line is a straight line, and the second line is a serpentine line.

21. The tunable embedded inductor device as claimed in claim 18, wherein the first line is a straight line, and the second line is a spiral line.

22. The tunable embedded inductor device as claimed in claim 15, wherein the dielectric substrate comprises a polymer substrate, a ceramic substrate, a semiconductor substrate, or composites thereof.

23. The tunable embedded inductor device as claimed in claim 15, wherein the dielectric substrate comprises a circuit composed of at least one active device or passive device.

24. The tunable embedded inductor device as claimed in claim 15, wherein the primary coil is a multi-layered coil and the dielectric substrate is a multi-layered substrate, and the tunable embedded inductor device further comprises a third conductive line disposed on an inner layer's surface of the multi-layered substrate, wherein the interconnection comprises a first interconnection connecting end sites of both the first conductive line and the third conductive line; and a second interconnection connecting end sites of both the second conductive line and the third conductive line.

* * * * *